US009957693B2

(12) United States Patent
Fischmann Torres et al.

(10) Patent No.: US 9,957,693 B2
(45) Date of Patent: May 1, 2018

(54) SUCTIONING DEVICE FOR LARGE ARTIFICIAL WATER BODIES

(71) Applicant: CRYSTAL LAGOONS (CURACAO) B.V., Curacao (NL)

(72) Inventors: Fernando Benjamin Fischmann Torres, Santiago (CL); Jorge Eduardo Prieto Dominguez, Santiago (CL)

(73) Assignee: Crystal Lagoons (Curacao) B.V., Curacao (NL)

( * ) Notice: Subject to any disclaimer, the term of this patent is extended or adjusted under 35 U.S.C. 154(b) by 0 days. days.

(21) Appl. No.: 15/308,577

(22) PCT Filed: Nov. 12, 2014

(86) PCT No.: PCT/IB2014/065981
§ 371 (c)(1),
(2) Date: Nov. 2, 2016

(87) PCT Pub. No.: WO2016/075513
PCT Pub. Date: May 19, 2016

(65) Prior Publication Data

US 2017/0073926 A1 Mar. 16, 2017

(51) Int. Cl.
*E04H 4/16* (2006.01)
*E02F 3/88* (2006.01)
(Continued)

(52) U.S. Cl.
CPC ..... *E02F 3/8866* (2013.01); *E02F 3/885* (2013.01); *E02F 3/9243* (2013.01);
(Continued)

(58) Field of Classification Search
CPC ..... E04H 4/16; E04H 4/1664; E04H 4/1636; E04H 5/28; E04H 4/1672
(Continued)

(56) References Cited

U.S. PATENT DOCUMENTS 2,071,520 A 2/1937 Harrison
2,141,811 A 12/1938 Everson
(Continued)

FOREIGN PATENT DOCUMENTS

CN 1256250 6/2000
CN 102092824 6/2011
(Continued)

OTHER PUBLICATIONS

U.S. Appl. No. 14/444,781, filed Jul. 28, 2014, Process to Maintain Large Clean Recreational Bodies of Water.
(Continued)

*Primary Examiner* — Michael Jennings
(74) *Attorney, Agent, or Firm* — Merchant & Gould P.C.

(57) ABSTRACT

A suctioning device for suctioning impurities from the bottom of large artificial water bodies is provided. The suctioning device includes a flexible sheet configured to provide a structural frame; a plurality of first brushes depending from the sheet; a plurality of middle brushes; a plurality of lateral brushes; a plurality of suction points; a plurality of wheels configured to provide secondary support when the brushes are worn out; a plurality of collectors configured to gather the suctioned water into external suction lines; a plurality of internal suction lines configured to conduit the suctioned bottom water flow from the plurality of suction points to the plurality of collecting means; and a coupling device connecting the internal suction lines and the collectors, wherein a rate of the bottom water flow entering the suctioning device is the same or higher than a rate of water flow suctioned by an external pumping system.

31 Claims, 5 Drawing Sheets

(51) Int. Cl.
*E02F 3/92* (2006.01)
*E02F 5/28* (2006.01)
*E02F 9/26* (2006.01)

(52) U.S. Cl.
CPC ..... *E02F 3/9293* (2013.01); *E02F 5/28* (2013.01); *E02F 9/261* (2013.01); *E04H 4/1645* (2013.01); *E04H 4/1672* (2013.01); *E04H 4/1636* (2013.01); *E04H 4/1654* (2013.01)

(58) Field of Classification Search
USPC ..... 15/1.7
See application file for complete search history.

(56) References Cited

U.S. PATENT DOCUMENTS 2,276,943 A 3/1942 Dow
2,314,767 A 3/1943 Burrell
2,646,889 A 7/1953 August
2,923,954 A 2/1960 Babcock
3,132,773 A 5/1964 Hampton
3,247,053 A 4/1966 Hodge
3,266,631 A 8/1966 Snaper
3,317,925 A 5/1967 Vance
3,321,787 A 5/1967 Myers
3,361,150 A 1/1968 Horner
3,406,416 A 10/1968 Presby et al.
3,412,862 A 11/1968 Chaplin
3,419,916 A 1/1969 Schankler
3,470,091 A 9/1969 Budd et al.
3,517,513 A 6/1970 Trippe
3,540,274 A 11/1970 Shore
3,616,923 A 11/1971 Haley
3,641,594 A 2/1972 Hough
3,660,957 A 5/1972 Schankler
3,695,434 A 10/1972 Whitten, Jr.
3,748,810 A 7/1973 Mattingly
3,788,982 A 1/1974 Zsoldoes, Jr. et al.
3,844,760 A 10/1974 Nelson
3,887,666 A 6/1975 Heller et al.
3,949,442 A 4/1976 Chandler
3,950,809 A 4/1976 Schatzmann
4,055,491 A 10/1977 Porath-Furedi
4,060,575 A 11/1977 Uhlirsch et al.
4,063,419 A 12/1977 Garrett
4,087,870 A 5/1978 Palmer
4,090,266 A 5/1978 Price
4,100,641 A 7/1978 Pansini
4,117,683 A 10/1978 Rasmussen
4,119,535 A 10/1978 White
4,129,904 A 12/1978 Pansini
4,176,058 A 11/1979 Grobler
4,231,873 A 11/1980 Swigger
4,254,525 A 3/1981 Combest
4,263,759 A 4/1981 Miller
4,254,818 A 10/1981 Melamed
4,304,022 A 12/1981 Sommer
4,306,967 A 12/1981 Trautwein
4,338,697 A 7/1982 Broadwater
4,343,696 A 8/1982 Hung
RE31,087 E 11/1982 Sohl
4,402,101 A 9/1983 van Zyl
4,464,215 A 8/1984 Cogliano
4,519,914 A 5/1985 Etani
4,548,371 A 10/1985 Dempsey
4,572,767 A 2/1986 McCord
4,581,075 A 4/1986 St. Martin
4,592,291 A 6/1986 Sullivan, III
4,640,784 A 2/1987 Cant
4,652,378 A 3/1987 Marikovsky et al.
4,692,956 A 9/1987 Kassis
4,752,740 A 6/1988 Steininger
4,767,511 A 8/1988 Aragon
4,768,532 A 9/1988 Johnson
4,776,053 A 10/1988 Kiraly
4,835,810 A 6/1989 Hugo
4,849,024 A 7/1989 Supra
4,880,547 A 11/1989 Etani
4,889,622 A 12/1989 Newcombe-Bond
4,909,266 A 3/1990 Massa
4,931,187 A 6/1990 Derham et al.
4,944,872 A 7/1990 Kantor
4,948,296 A 8/1990 Salter
4,952,398 A 8/1990 Tapin
5,028,321 A 7/1991 Stone et al.
5,039,427 A 8/1991 Conover
5,080,783 A 1/1992 Brown
5,106,229 A 4/1992 Blackwell
5,107,872 A 4/1992 Meincke
5,108,514 A 4/1992 Ksiner
5,143,623 A 9/1992 Kroll
5,164,094 A 11/1992 Stuckart
5,172,445 A 12/1992 Chandler
5,245,723 A 9/1993 Sommer
5,268,092 A 12/1993 Eden
5,293,659 A 3/1994 Rief et al.
5,337,434 A 8/1994 Erlich
5,342,570 A 8/1994 Ledoux et al.
5,346,566 A 9/1994 White
5,398,361 A 3/1995 Cason
5,411,889 A 5/1995 Hoots et al.
5,422,014 A 6/1995 Allen et al.
5,454,129 A 10/1995 Kell
5,482,630 A 1/1996 Lee et al.
5,569,371 A 10/1996 Perling
5,616,239 A 4/1997 Wendell et al.
5,662,940 A 9/1997 Hight et al.
5,782,480 A 7/1998 Phillips
5,802,631 A 9/1998 Friedman
5,833,841 A 11/1998 Koslowsky
5,842,243 A 12/1998 Horvath et al.
5,985,156 A 11/1999 Henkin et al.
6,017,400 A 1/2000 Clark et al.
6,149,819 A 11/2000 Martin et al.
6,224,826 B1 5/2001 Katakura et al.
6,228,272 B1 5/2001 Gola
6,231,268 B1 5/2001 Hausenbauer
6,280,639 B1 8/2001 Ortiz
6,284,144 B1 9/2001 Itzhak
6,303,038 B1 10/2001 Sanders et al.
6,317,901 B1 11/2001 Corpuel
6,358,409 B1 3/2002 Jacoby, Jr. et al.
6,409,926 B1 6/2002 Martin
6,419,840 B1 7/2002 Meincke
6,444,176 B1 9/2002 Yoshinaga et al.
6,539,573 B1 4/2003 Caccavella
6,620,315 B2 9/2003 Martin
6,896,799 B2 5/2005 Ohanian
7,163,619 B2 1/2007 Wang
7,189,314 B1 3/2007 Pace et al.
7,252,843 B2 8/2007 Moore et al.
7,820,055 B2 10/2010 Fischmann
7,832,959 B1 11/2010 Groen et al.
7,862,712 B2 1/2011 Tak
8,062,514 B2 11/2011 Fischmann
8,070,342 B2 12/2011 Ishikawa et al.
8,070,942 B2 12/2011 Fischmann
8,153,010 B2 4/2012 Duarte et al.
8,388,837 B2 3/2013 Tormaschy et al.
8,454,838 B2 * 6/2013 Fischmann ..... C02F 9/00 210/742
8,465,651 B2 6/2013 Fischmann
8,518,269 B2 8/2013 Fischmann
8,524,088 B2 9/2013 Arbogast et al.
2002/0117430 A1 8/2002 Navarro et al.
2003/0046933 A1 3/2003 Moss et al.
2003/0091467 A1 5/2003 Kmec et al.
2003/0094421 A1 5/2003 Gargas
2003/0228195 A1 12/2003 Mizutani
2004/0025269 A1 2/2004 Pichon
2004/0129644 A1 7/2004 Unhoch
2004/0211450 A1 10/2004 Stoltz
2004/0217326 A1 11/2004 Souter et al.

(56) References Cited

U.S. PATENT DOCUMENTS

| | | | |
|---|---|---|---|
| 2004/0226896 | A1 | 11/2004 | Lovestead et al. |
| 2005/0009192 | A1 | 1/2005 | Page |
| 2005/0016906 | A1 | 1/2005 | Gettman |
| 2005/0063782 | A1 | 3/2005 | Stoecker et al. |
| 2005/0091934 | A1 | 5/2005 | Kantor |
| 2005/0145552 | A1 | 7/2005 | Sheets |
| 2005/0194322 | A1 | 9/2005 | Palmer |
| 2005/0207939 | A1 | 9/2005 | Roussi et al. |
| 2006/0054568 | A1 | 3/2006 | Jones et al. |
| 2006/0169322 | A1 | 8/2006 | Torkelson |
| 2006/0174430 | A1 | 8/2006 | Pareti |
| 2006/0265820 | A1 | 11/2006 | Erlich et al. |
| 2006/0283808 | A1 | 12/2006 | Kadlec et al. |
| 2007/0059562 | A1 | 3/2007 | Hattori et al. |
| 2007/0181498 | A1 | 8/2007 | Kaas |
| 2007/0181510 | A1 | 8/2007 | Harvey et al. |
| 2008/0116142 | A1 | 5/2008 | Fischmann |
| 2008/0190849 | A1 | 8/2008 | Vuong |
| 2008/0295615 | A1 | 12/2008 | Sihalla |
| 2009/0050572 | A1 | 2/2009 | McGuire et al. |
| 2009/0087549 | A1 | 4/2009 | Zhou et al. |
| 2010/0108490 | A1 | 5/2010 | Hamers et al. |
| 2010/0320147 | A1 | 12/2010 | McGuire et al. |
| 2011/0009019 | A1 | 1/2011 | Neira et al. |
| 2011/0061194 | A1 | 3/2011 | Fischmann |
| 2011/0062067 | A1 | 3/2011 | Fischmann |
| 2011/0108472 | A1 | 5/2011 | Kania |
| 2011/0108490 | A1 | 5/2011 | Fischmann |
| 2011/0110076 | A1 | 5/2011 | Langner |
| 2011/0132815 | A1 | 6/2011 | Angellili et al. |
| 2011/0137465 | A1 | 6/2011 | Angelilli et al. |
| 2011/0210076 | A1 | 9/2011 | Fischmann |
| 2011/0253638 | A1 | 10/2011 | Easland et al. |
| 2012/0024794 | A1 | 2/2012 | Fischmann |
| 2012/0024796 | A1 | 2/2012 | Fischmann |
| 2012/0091069 | A1 | 4/2012 | Fischmann |
| 2012/0103445 | A1 | 5/2012 | Santamaria |
| 2012/0216837 | A1 | 8/2012 | Kovarik et al. |
| 2013/0240432 | A1 | 3/2013 | Fischmann |
| 2013/0213866 | A1 | 8/2013 | Fischmann |
| 2013/0264261 | A1 | 10/2013 | Fischmann |
| 2013/0306532 | A1 | 11/2013 | Fischmann |
| 2014/0190897 | A1 | 7/2014 | Wilson |

FOREIGN PATENT DOCUMENTS

| | | |
|---|---|---|
| DE | 2 141 460 | 2/1973 |
| DE | 38 44 374 | 7/1990 |
| DE | 19515428 | 11/1996 |
| DE | 297 16 994 | 1/1998 |
| DE | 198 14 705 | 10/1998 |
| DE | 198 60 568 | 12/1998 |
| DE | 10 2010 019 510 | 11/2011 |
| EP | 0 352 487 | 1/1990 |
| EP | 0 468 876 | 1/1992 |
| EP | 0 483 470 | 5/1992 |
| EP | 1 420 130 | 5/2004 |
| EP | 168 85 62 | 8/2006 |
| ES | 200 14 29 | 5/1998 |
| FR | 2 544 005 | 10/1984 |
| FR | 2 668 527 | 4/1992 |
| FR | 2 685 374 | 6/1993 |
| FR | 2 740 493 | 4/1997 |
| FR | 2 785 898 | 5/2000 |
| GB | 1494005 | 12/1977 |
| GB | 2045606 | 11/1980 |
| GB | 2 243 151 | 10/1991 |
| JP | 59-012287 | 1/1984 |
| JP | 59-222294 | 12/1984 |
| JP | 4-115008 | 4/1992 |
| JP | 5-220466 | 8/1993 |
| JP | 04073612 | 8/1993 |
| JP | 5-261395 | 10/1993 |
| JP | 7-310311 | 11/1995 |
| JP | 3026643 | 1/1996 |
| JP | 10-169226 | 6/1998 |
| JP | 2001-3586 | 1/2001 |
| JP | 2001-9452 | 1/2001 |
| JP | 2002-90339 | 3/2002 |
| JP | 2002-282860 | 10/2002 |
| JP | 2003-190989 | 7/2003 |
| JP | 2003-200173 | 7/2003 |
| JP | 2004-958 | 1/2004 |
| JP | 2005-288392 | 10/2005 |
| JP | 2006-68624 | 3/2006 |
| JP | 2007-500073 | 1/2007 |
| JP | 2011-5463 | 1/2011 |
| KR | 20-0162956 | 9/1999 |
| TW | 432013 | 8/1987 |
| TW | 482186 | 12/1990 |
| UY | 30184 | 5/2007 |
| WO | WO 8101585 | 6/1981 |
| WO | WO 9848132 | 10/1998 |
| WO | WO 03/010388 | 2/2003 |
| WO | WO 2006/069418 | 7/2006 |
| WO | WO 2007/029277 | 3/2007 |
| WO | WO 2007/059562 | 5/2007 |
| WO | WO 2009/114206 | 9/2009 |
| WO | WO 2010/074770 | 7/2010 |

OTHER PUBLICATIONS

U.S. Appl. No. 14/531,395, filed Nov. 3, 2014, Floating Lake System and Methods of Treating Water Within a Floating Lake.

U.S. Appl. No. 15/462,534, filed Mar. 17, 2017, Floating Lake System and Methods of Treating Water Within a Floating lake.

U.S. Appl. No. 14/823,052, filed Aug. 11, 2015, System and Method for Maintaining Water Quality in Large Water Bodies.

African Regional Intellectual Property Organization (ARIPO) report for corresponding application No. AP/P/2007/004242 dated Dec. 7, 2010.

Ballentine, "Ambient Water Quality Criteria for Bacteria—1986", Jan. 1986, United States EPA, EPA440/5-84-002, p. 16.

Chilean Examiner's report from Application No. 3900-08 dated Aug. 31, 2009.

Communication from EPO for corresponding application No. 09835402.0 dated Jan. 30, 2013.

Eurasian Office Action for corresponding application No. 201001477/31 and response to Office Action dated Apr. 2, 2013 with English Translation.

European Search Report from European Application No. 07 07 5995 dated Mar. 9, 2010.

International Search Report and Written Opinion for International Application No. PCT/US2011/051129 dated Feb. 8, 2012.

International Search Report and Written Opinion for International Application No. PCT/US2011/051236 dated Jan. 26, 2012.

International Search Report and Written Opinion for International Application No. PCT/US2011/051244 dated Jan. 25, 2012.

International Search Report and Written Opinion for PCT/EP2012/076170 dated Aug. 5, 2013.

International Search Report dated May 6, 2009, in co-pending related PCT Application No. PCT/US2009/036809.

Japanese Office Action for corresponding application No. 2007-299975 dated May 31, 2011—translation provided.

Norwegian Search Report from Norwegian Application No. 20075880 dated Feb. 4, 2010.

Pakistan Examination Report, 2010.

Panama Search Report from Panama Application No. 87176-01 dated Mar. 17, 2010.

Panama Search Report from Panama Application No. 88509-01 dated Oct. 7, 2010.

Peruvian Technical Report for corresponding application No. 000244-2007 dated Sep. 2, 2010—translation provided.

Response filed for EP 09835402.0 dated Aug. 14, 2013.

Response filed for EP 09835402.0 dated Jul. 23, 2013.

Second Singapore Office Action for corresponding application No. 200717963-3 dated Dec. 23, 2010.

Singapore Office Action for corresponding application No. 200717963-3 dated Dec. 23, 2010.

(56) References Cited

OTHER PUBLICATIONS

World Health Organization: Guidelines for safe recreational waters. vol. 2. Swimming pools and similar recreational water environments. Switzerland. Jun. 27, 2006 ISBN 92-4-154680-8 Chapter 4.
World Health Organization: Guidelines for safe recreational waters. vol. 2. Swimming pools and similar recreational water environments. Switzerland. Jun. 27, 2006 ISBN 92-4-154680-8 Chapter 5.
International Search Report and Written Opinion for International Application No. PCT/IB2014/002991 dated May 18, 2015.
International Search Report and Written Opinion for PCT/IB2014/065981, dated Mar. 18, 2015.
International Search Report and Written Opinion for International Application No. PCT/IB2014/002891 dated Apr. 29, 2015.

* cited by examiner

SUCTIONING DEVICE FOR LARGE ARTIFICIAL WATER BODIES

This application is a National Stage Application of PCT/IB2014/065981, filed 12 Nov. 2014, which application is incorporated herein by reference. To the extent appropriate, a claim of priority is made to the above disclosed application.

TECHNICAL FIELD

The present invention relates to a suctioning device for suctioning flocs from the soft bottom of large artificial water bodies, where the bottom surface of the large artificial water bodies can be irregular and sloped. U.S. Pat. No. 8,062,514, U.S. Pat. No. 8,070,942, U.S. Pat. No. 7,820,055, U.S. Pat. No. 8,454,838, U.S. Pat. No. 8,465,651, U.S. Pat. No. 8,518,269, U.S. Pat. No. 8,070,342, and U.S. Patent Application Publication No. 20110110076, 20110108490, No. 20130240432, No. 20130264261, No. 20130213866, No. 20130306532, and No. 20110210076 are each hereby incorporated by reference in its entirety.

BACKGROUND

Today in the world, one can distinguish two different technologies for maintaining water bodies.

On the one hand, one can distinguish conventional swimming pool water treatment technologies, which will be referred to as "Technology A". On the other hand, one can distinguish an innovative water treatment technology for treating and maintaining large artificial water bodies, such as large artificial water bodies, which will be referred to as "Technology B". Both technologies are very different in nature, operation, configuration, and size, and are directed at very different objectives and water body types, and therefore the suctioning devices used for each technology are completely different.

Technology A, which refers to conventional swimming pool treatment technology, is used in small and confined water bodies with specific characteristics and usually built out of concrete with plain, regular, and firm bottoms. Since swimming pools have low sizes, their regulations require filtering the complete water body between 1 and 6 times per day to maintain a suitable water quality for recreational purposes.

Technology B, on the other hand, allows treating and maintaining large water bodies that have irregular and soft bottoms built of out plastic liners, and where such water is treated though efficient flocculation that allows precipitating impurities, and afterwards removing the settled impurities and debris from the irregular and unfirm bottoms, especially the flocs that are formed in the water treatment process, thus avoiding the use of conventional centralized filtration systems and conventional swimming pool technologies such as Technology A.

Swimming pools using Technology A generally use conventional swimming pool bottom cleaners, and there are many different types and models within the market, which have been specially designed to clean the bottom of relatively small recreational water bodies such as swimming pools, among other applications. Such pool cleaners are configured to clean small surfaces, and therefore their surface cleaning rates (i.e., the amount of bottom surface cleaned in a predetermined period of time) are low and would not be practical for cleaning the bottom of large artificial water bodies using the Technology B due to their large sizes.

Also, such cleaning devices are configured to clean smooth surfaces that do not present irregularities or bumps. For example, typical swimming pools are built out of concrete, fiberglass, or other materials that may be coated to provide a firm, plain, regular, and smooth surface. Therefore, such surfaces can be easily cleaned by conventional pool bottom cleaning devices. These conventional pool bottom cleaning devices are therefore not designed to clean soft and irregular surfaces such as the bottom of large artificial water bodies using Technology B, as the operation would be extremely inefficient and may even damage the bottom.

It must also be noted that the conventional swimming pool cleaners generally are provided with small suction heads, usually with scrubbers. The scrubbers are typically moved from the perimeter of the pool by rods or poles. This is possible due to the small surfaces that must be covered. These conventional cleaners are designed to remove the attached debris and stains found on the bottom and walls of the swimming pools. However, even though the small suction heads remove the debris from the bottom of the pool, the conventional centralized filtration system of the swimming pool must still be used to treat the contaminations suspended in the water, where the conventional filtration system filters the complete water body from 1 to 6 times per day to purify the water.

Also, many of such devices for swimming pools using Technology A utilize rotating brushes, scrubbers or other systems that may cause the flocs to disperse and/or re-suspend, and also may comprise filters attached to the suctioning devices, which is not applicable to large artificial water bodies using Technology B due to the large water volumes that must be filtered.

Conventional pool cleaning devices are typically permanently supported by a series of wheels, which although have little or no impact on the bottom surface of conventional pools (typically formed from concrete, fiberglass, or other materials that may be coated to provide a firm, plain, regular, and smooth surface), can damage the bottom liner of water bodies using Technology B since the bottom has irregular surfaces and therefore the wheels could cause undesired stresses including, for example, stretching and folding of the material of the liner. Additionally, if a sharp object, such as a stick, rock or other debris is located above or below the plastic liners, the weight/pressure caused by the wheels could cause the liner to puncture, causing damage and leaking of the water.

Moreover, as a result of the irregular surfaces present (i.e., areas or zones that have higher or lower depths), they cannot be cleaned properly through such conventional bottom cleaners. Additionally, the conventional bottom suction cleaners used in Technology A cannot work at high speeds. As a sediment cloud is lifted by such devices, suctioning all of the bottom layer sediments is nearly impossible. The sediment cloud causes mixing and turbulence on the bottom layer of the water body, reducing sedimentation capacity and thus not allowing to properly treating the water body.

TABLE 1

Differences between Technology A and Technology B

| Features | Technology A Small Swimming Pools | Technology B Large Artificial Water Bodies |
|---|---|---|
| Average Water Surface | Generally 80 m2 Olympic Pool: 1,250 $m^2$ | Generally 30,000 $m^2$-400,000 $m^2$ |
| Bottom material | Concrete | Natural terrain used as bottom, covered with plastic liners |
| Bottom surface | Smooth, regular, plain, firm | Irregular, soft, with protrusions |
| Water treatment | Permanent high concentration of chemicals | Efficient flocculation that allows precipitating impurities into the bottom |
| Uses flocculants | Optional | Mandatory |
| Filtration | Use of conventional centralized filtration system | Does not require a centralized filtration system |
| Use of suctioning device for treating the water | No—small suctioning devices are just used for removing attached debris and stains | Yes—the device allows removing the flocculated impurities from the bottom of the artificial water bodies |
| Cleaning Device Operation | Slow operation due to the small sizes of swimming pools | Use of fast propelling device due to the large areas that must be covered |
| Cleaning device | Rotating parts and scrubbers to detach debris and stains | No rotating parts in order to avoid re-suspension of precipitated material |

Large water bodies using Technology B can be used for recreational purposes, such as for practicing water sports, bathing, and many other activities that allow improving the lifestyle of people around the world. Large water bodies can also be used for industrial purposes, such as for cooling purposes, drinking water storage and treatment, raw water storage, seawater treatment for reverse osmosis and mining applications, and many other applications.

Such large water bodies using the Technology B typically have irregular and soft bottoms. This often results from the positioning of a liner, often plastic, directly on a natural surface. The water contained in the large water bodies is often treated though, efficient flocculation that allows precipitating impurities, and afterwards removing the settled impurities from the irregular and soft bottoms, especially the flocs that are formed in the water treatment process, thus avoiding the need for conventional centralized filtration systems.

Conventional small devices for removing attached debris and stains from the bottom of conventional swimming pools using Technology A are not configured to clean large surface areas in short periods of time, and are also not configured to be propelled by a propelling device, such as a boat with an engine or a robotic system internally or externally connected to the device, since they are designed for small areas that do not present surface cleaning difficulties as the bottoms of conventional swimming pools using Technology A are usually built with concrete and are very regular and smooth.

One conventional suction device for Technology A comprises a suction head that can be moved along the lower surface of a swimming pool by an articulated rod by hand (therefore limiting the covered area and velocity of the cleaning process). Such device improves the service life of conventional suction heads that comprise bristles that are easily removed in order to be replaced in case they are worn out. Therefore, such suction device aims to replace worn bristles with unworn bristles so that the suction head's service life is no longer limited by the life of the occupied bristles.

Another conventional system for Technology A includes a vacuum head with parallel rows of brushes with a predetermined advancing direction and flexible foam for containing the water within the device in order to be suctioned. This device is designed to clean small swimming pools and provide an efficient suction due to the lock comprising flexible foam. However, this vacuum head is designed to clean regular (i.e., flat) bottoms of swimming pools, for example made of concrete, and not to cope with irregular bottoms as the ones from large artificial water bodies. Such a device includes a support plate to minimize the bending of the flexible foam, and a support wheel to provide stability to the device as it rolls along the surface to be cleaned.

Other devices include a suction head for conventional swimming pools using Technology A, having one central suction nozzle and an elongate main brush and auxiliary brushes to support the cleaning head, where the head is configured to move the debris into the central suction nozzle. This design causes re-suspension of debris since it has many openings within the suction head that just move and re-suspend the impurities instead. Such head is designed to be fitted into a conventional swimming pool vacuum cleaner, with a hand driven pole for moving the head, and a system to suction and filter the suctioned water within the same swimming pool, and therefore could not be used for large applications or for cleaning large surface areas in short periods of time.

Other types of vacuum heads for swimming pools using Technology A include a sphere-supported swimming pool suction head, comprising a plurality of rotatable spheres in base plate sockets to support the base plate above the pool floor. Therein, the suction head is maneuvered from the edge of the pool by a long pole. Although the base plate is a rectangular and flexible plate, the device is supported on rotatable spheres to provide a low rolling friction to aid handling ease, which is completely directed to solving the maneuverability issues from the border of the swimming pools. As this system is driven by hand within the perimeter, it could not be used for large applications or for cleaning large surface areas in short periods of time. Also, the rotatable spheres do not allow handling protrusions or irregularities in the bottom of large artificial water bodies, since they could damage the coatings from such large artificial water bodies.

Therefore, it must be noted that none of the suction cleaners used for operation in swimming pools according to Technology A would be useful or efficient for suctioning the bottom of large artificial water bodies using Technology B.

However, a few specific suction devices have been developed for use in large artificial water bodies according to Technology B, where such suctioning devices have presented many limitations associated with suctioning device speed, reversibility, turning capacity, suctioning efficiency, operation in irregular surfaces, and operation in sloped bottoms, among others.

SUMMARY

In general terms, this invention is directed to a suctioning device for suctioning, inter alia, flocs produced by flocculants or coagulants and debris found in the bottom of water bodies using Technology B. In one possible configuration and by non-limiting example, the suctioning device is configured to operate at large artificial water bodies using the innovative water treatment Technology B that allows treating and maintaining large water bodies that have irregular and soft bottoms built of out plastic liners, and where such water is treated though efficient flocculation that allows precipitating impurities, and afterwards removing the settled impurities from the irregular and soft bottoms, especially the flocs that are formed in the water treatment process, thus avoiding the use of conventional centralized filtration systems and conventional swimming pool technologies.

Various aspects are described in this invention, which include, but are not limited to, the following aspects.

One aspect is a suctioning device for suctioning flocs produced by flocculants or coagulants from a bottom of large artificial water bodies using the innovative water treatment Technology B that allows treating and maintaining large water bodies that have irregular and soft bottoms built of out plastic liners, and where such water is treated though efficient flocculation that allows precipitating impurities, and afterwards removing the settled impurities from the irregular and soft bottoms, especially the flocs that are formed in the water treatment process, thus avoiding the use of conventional centralized filtration systems and conventional swimming pool technologies.

The suctioning device typically includes a flexible sheet configured to provide a structural frame; a plurality of first brushes, where in an embodiment the first brushes are V-shaped brushes configured to direct a bottom water flow into apexes of the V-shaped brushes; a plurality of middle brushes configured to redirect the bottom water flow into the first brushes; a plurality of lateral brushes configured to contain the bottom water flow within the suctioning device and avoid the re-suspension of the bottom water flow in the vicinity of the suctioning device; a plurality of suction points configured to concentrate suction capacity to increase suction power in the suction points; a plurality of safety wheels configured to provide secondary support and avoid damage to the suctioning device when the first brushes, the middle brushes, and/or the lateral brushes are worn out and cannot provide a proper support or suction height of the suctioning device; a plurality of collecting means configured to gather the suctioned bottom water flow and concentrate the suctioned bottom water flow into one or more external suction lines; a plurality of internal suction lines configured to conduit the suctioned bottom water flow from the plurality of suction points to the plurality of collecting means; and a plurality of couplers, connecting the internal suction lines and the collecting means. The suctioning device has a rate of the bottom water flow entering the suctioning device that is the same or higher than a rate of water flow suctioned by an external pumping system though the device.

DETAILED DESCRIPTION

Figure 1:
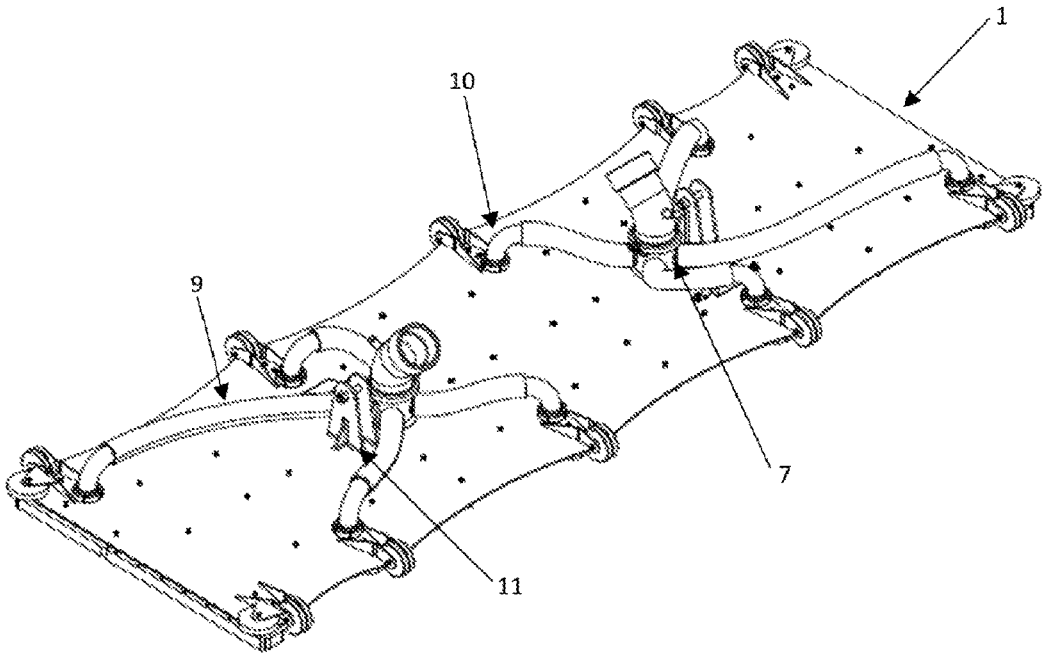
FIG. 1 shows a schematic, top perspective view of an exemplary suctioning device.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

The following detailed description refers to the accompanying drawings. While embodiments of the invention may be described, modifications, adaptions, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the scope of the invention. While systems and methods are described in terms of "comprising" various apparatus or steps, the systems and methods can also "consist essentially of" or "consist of" the various apparatus or steps, unless stated otherwise.

As mentioned, currently one can distinguish two different technologies to maintain water bodies for recreational purposes, the first one referring to conventional swimming pool water treatment or Technology A, which are used in small water bodies with specific characteristics and usually built out of concrete with plain, regular, and firm bottoms and that require a centralized filtration system; and the second one referring to an innovative water treatment technology, or Technology B, that allows treating and maintaining large water bodies that have irregular and soft bottoms built of out plastic liners, and where such water is treated though efficient flocculation that allows precipitating impurities, and afterwards removing the settled impurities from the irregular and soft bottoms, especially the flocs that are formed in the water treatment process, thus avoiding the use of conventional centralized filtration systems.

Very large artificial water bodies are typically built without centralized filtration systems and using the aforementioned innovative water treatment Technology B, where such large artificial water bodies are constantly increasing in size, and therefore there is a need for providing low cost and efficient bottom cleaning devices for large water bodies, larger than 10,000 $m^2$ in surface area. Such large artificial water bodies with surface area higher than 10,000 $m^2$ can be artificial lakes, ponds, swimming pools, tanks, basins, lagoons, and similar water bodies. Regarding bottom cleaning systems for maintaining the large artificial water bodies using the innovative Technology B of water treatment through efficient flocculation and without centralized filtration systems, there are a few types of suction devices directed to cleaning the bottom of large artificial water bodies, larger than 10,000 $m^2$. It must be noted that large swimming pools using Technology A generally have sizes of up to 1,250 $m^2$, corresponding to Olympic sized swimming pools. Such innovative water treatment systems, which do not require centralized filtration systems, implement treatment by adding different oxidants, coagulants, and flocculants to allow precipitation of the flocs to the bottom of the large artificial water bodies. Therefore, devices for suctioning such precipitated impurities must be able to avoid re-suspension of the settled impurities and remove them, while at the same time being able to cover large surface areas in short periods of time. Such suctioning devices are used for cleaning the bottom of artificial water bodies, where generally the devices move through the bottom of the artificial water bodies suctioning the bottom water flow in order to remove the flocs, debris, and/or the solids found on the bottom. The challenge to such technologies is that the bottom cleaning devices that are being used for cleaning the large artificial water bodies have several limitations related to surface cleaning rates, avoiding re-suspension of settled particles, velocity, capacity to clean irregular surfaces, wheel support, suction capacity, reversibility, weight, costs, and turning capacity, among other characteristics.

In such bottom cleaning devices for large artificial water bodies, the suction power is commonly spread throughout the complete length of the device through a continuous long and thin suction opening which in turn causes that the floccules resulting from the water treatment methods tend to disperse and lift, creating sediment clouds that generate cleaning and suctioning inefficiencies.

Such suctioning devices for large artificial water bodies are supported over wheels and are very heavy in order to avoid their lifting out of the bottom when pulled by a propelling device or to allow providing stability and adherence to the bottom when using internal propelling systems. However, such large weight causes difficulty in the maintenance of the suctioning device, as the device must be taken out of the water and put into the water to perform the maintenance and replacement of different pieces within the device, and also causes damage on the bottom due to the large weight over the wheel support. Also, the cost of such suctioning devices is expensive, and must be reduced in order to allow their application to more projects around the world.

Many large artificial water bodies throughout the world have irregular bottoms that are difficult to clean due to the requirement of being able to adapt the suction device into such irregularities, such as bumps, holes, different slopes, and other imperfections that may affect the evenly cleaning of the bottom surface. For example, small and conventional swimming pools using Technology A generally use manual cleaning methods for irregular surfaces, which could not be used efficiently in the large artificial water bodies.

Therefore, developed suctioning devices for large artificial water bodies using the innovative water treatment Technology B without centralized filtration systems have many limitations to efficiently and rapidly suction the flocs resulting from the water treatment method since the suction opening is configured continuously along the complete bottom of the device, and also such devices tend to produce damage on the bottom membranes due to their rigidity, weight, that they are supported over wheels and other variables; and therefore there is a need to provide a suction device able to efficiently suction the flocs at high speed and over irregular bottoms.

Conventional swimming pool cleaning devices for Technology A, which are designed to suction large debris from the bottom, are not designed to suction small precipitated impurities produced at large artificial water bodies with bottoms covered with plastic liners that do not have centralized filtration systems using Technology B. The suction configuration and requirements of devices for large artificial water bodies are very different from swimming pool cleaners that operate with conventional centralized filtration systems.

A suctioning device according to an embodiment of the present invention allows treating and maintaining large water bodies with surfaces larger than 10,000 $m^2$ at low cost, using the innovative Technology B for water treatment through efficient flocculation and without requiring centralized filtration systems. This new technology of the suctioning device is different than swimming pool technologies, in that efficient flocculation allow precipitation of impurities and removal of the settled impurities from the bottom of the large water bodies, especially the flocs that are formed in the water treatment process. In contrast, the swimming pool Technology A is applied to swimming pools, which have relatively low sizes. For example, Olympic swimming pools are generally the largest swimming pools and have surface areas of 1,250 $m^2$ and volumes of 2,500 $m^3$. On the other hand, the new technology of the suctioning device according to the present invention is applied to very large water bodies, such as artificial water bodies, that in average have surface areas of between 1 to 40 hectares—from about 100,000 $ft^2$ to about 4,000,000 $ft^2$ or from about 2.5 to about 100 acres—(at least 20 times larger than the large-sized swimming pools). Such very large artificial water bodies may have different construction methods as conventional swimming pools. For example, the very large artificial water bodies are typically built with plastic liners over the natural terrain that may be covered with sand, clay, or compacted, which generates an irregular bottom that presents difficulties to be cleaned.

The present invention relates to a flexible suctioning device for suctioning flocs from the bottom of large artificial water bodies with surfaces larger than 10,000 $m^2$ and with bottoms covered with plastic liners that do not have centralized filtration systems, and that is able to clean a bottom surface of large artificial water bodies at a surface cleaning rate of 325,000 $ft^2$ per 24 hours (30,000 $m^2$ per 24 hours) or more, where the bottom surface of the large artificial water bodies can be irregular and sloped, and where the suctioning device is reversible and is supported by a plurality of brushes, comprising first brushes, disposed to provide appropriate support to the suction device and minimize the dispersion and re-suspension of settled flocs. The suctioning device is designed in order to concentrate the suction power in a series of suction points, where the suctioning device is connected to an external filtration system that may not be attached to the suctioning device. The term "filtration system" or "filtration means" is used generally to indicate one or more filtering components, such as filters, strainers, and the like, or any combination thereof. The filtration system generally includes a pump to move water through the system.

Figure 2:
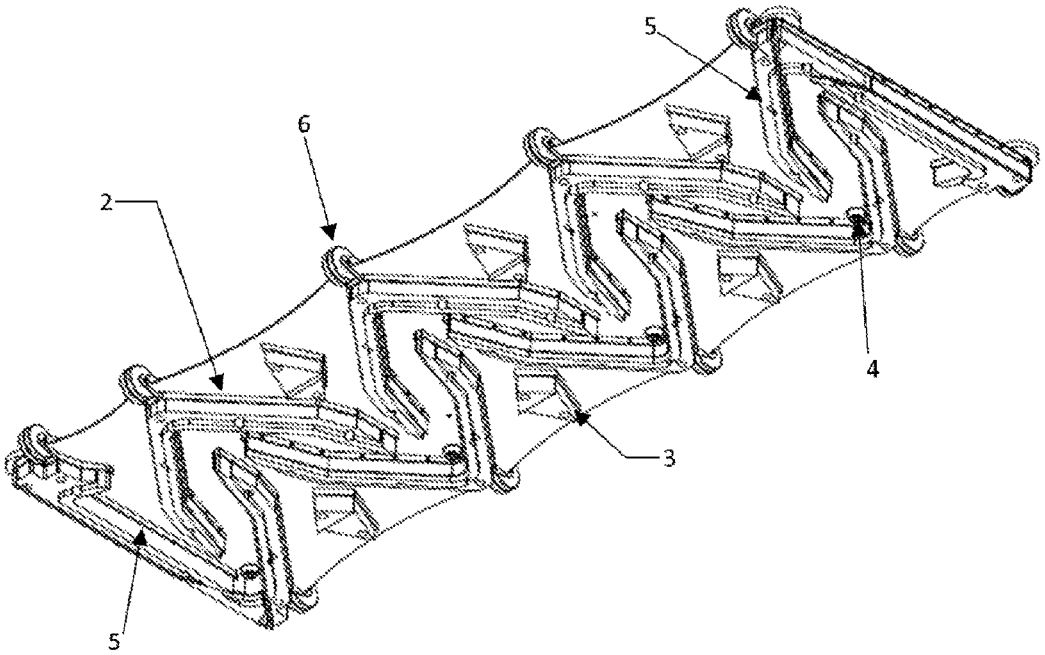
FIG. 2 shows a schematic, bottom perspective view of the suctioning device of FIG. 1.
Figure 3:
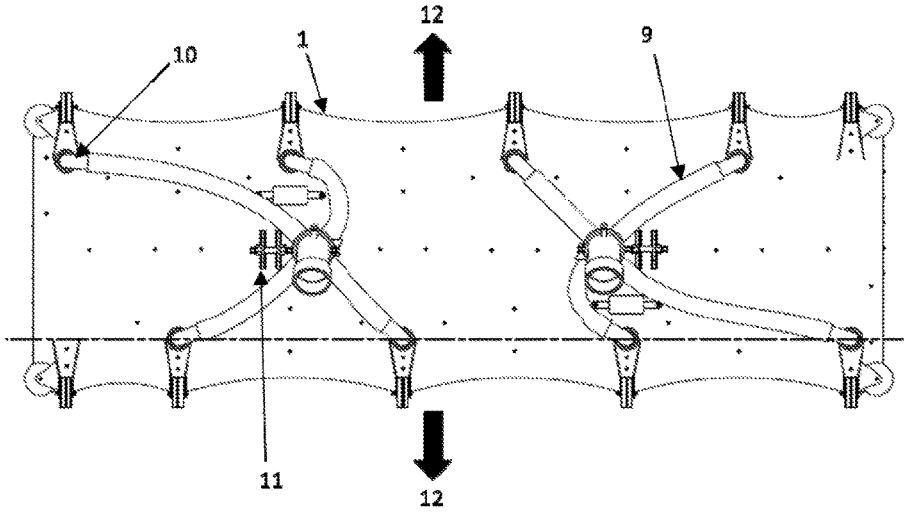
FIG. 3 shows a schematic, top view of the suctioning device of FIG. 1.
Figure 4:
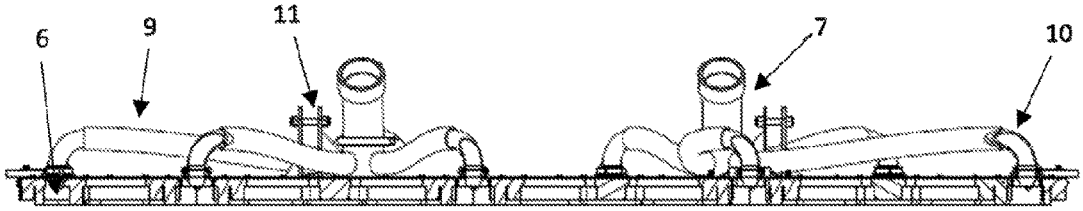
FIG. 4 shows a schematic, side view of the suctioning device of FIG. 1.
Figure 5:
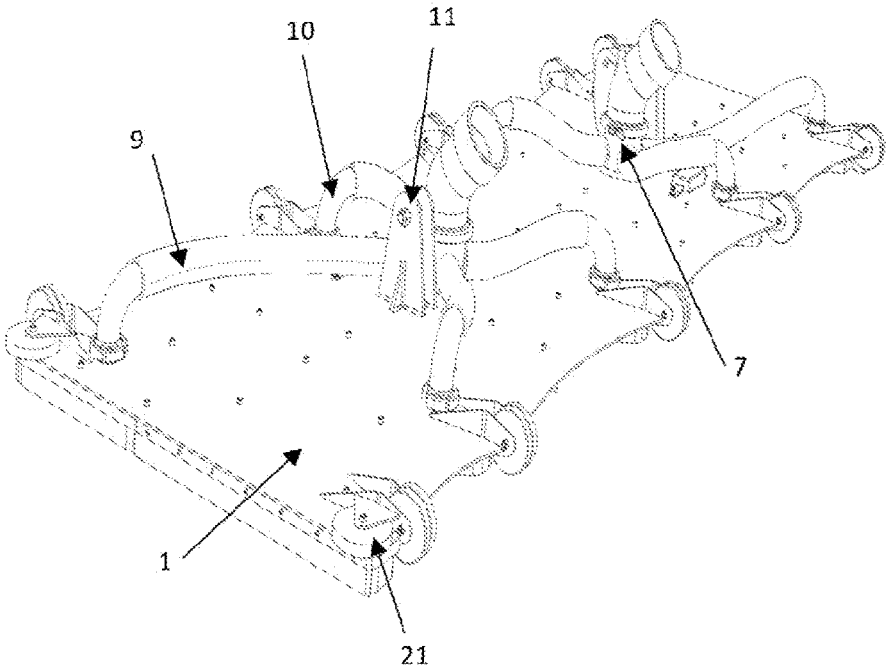
FIG. 5 shows a schematic, top perspective view of another exemplary suctioning device with lateral wheels.
Figure 6:
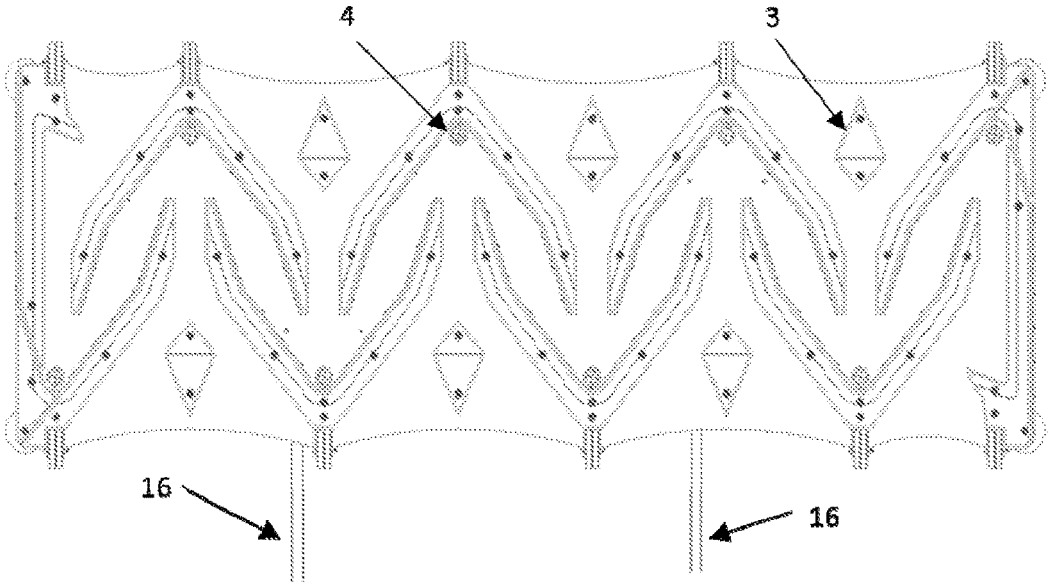
FIG. 6 shows a schematic, bottom view of the suctioning device of FIG. 5.
Figure 7:
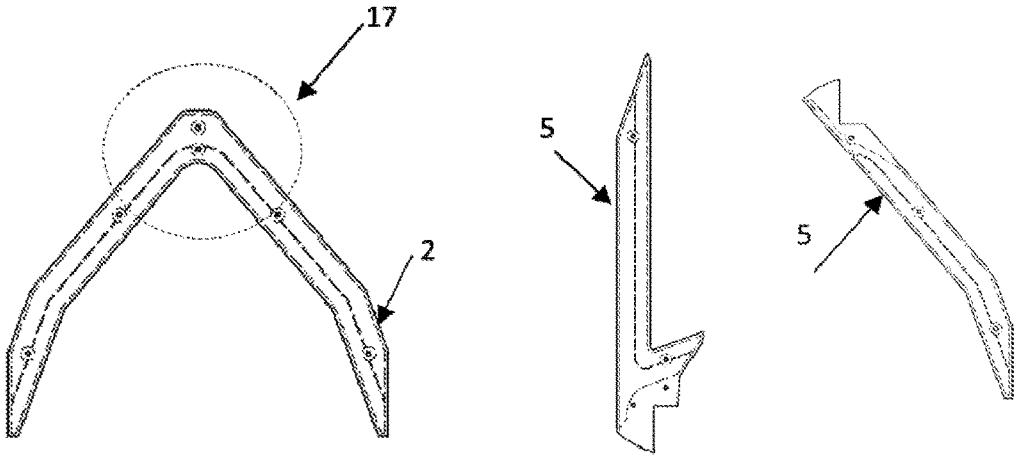
FIG. 7 shows exemplary V-shaped brushes and lateral brushes, showing the location of an apex where a suction point is located.

FIGS. 1-7 illustrate an exemplary suctioning device. In particular, FIG. 1 shows a schematic, top perspective view of the suctioning device. FIG. 2 shows a schematic, bottom perspective view of the suctioning device of FIG. 1. FIG. 3 shows a schematic, top view of the suctioning device of FIG. 1. FIG. 4 shows a schematic, side view of the suctioning device of FIG. 1. FIG. 5 shows a schematic, top perspective view of another exemplary suctioning device with lateral wheels. FIG. 6 shows a schematic, bottom view of the suctioning device of FIG. 5. FIG. 7 shows exemplary V-shaped brushes and lateral brushes, showing the location of an apex where a suction point is located.

A suction device according to the present invention typically comprises a flexible sheet 1 that provides the structural frame for attaching or affixing the different pieces and parts of the device. Depending on the material of the flexible sheet, the different parts can be welded, hanged, screwed, nailed, or joined by any other attachment method that allows providing stability to the attached part.

The flexible sheet can be built out of polycarbonate, polypropylene, carbon fiber, polyethylene, polystyrene, PTFE, PVC, acrylic, and metals such as steel, and composites thereof. The materials are typically water resistant, as the suctioning device is designed and manufactured to operate underwater. For example, in the case of using steel, a 316 stainless steel can be used.

In some embodiments, the flexible sheet has a certain weight to maintain the device underwater and avoid being lifted from the bottom while driven by a propelling device. In other embodiments, additional weight can be added to the device by means of different fixing types.

The flexible sheet 1 has a plurality of first brushes 2 attached to the underside thereof. In some embodiments, the first brushes are independent parts that can be easily removed or exchanged when a replacement is required due to the wearing down of the brushes. However in other embodiments, the first brushes are permanently affixed to the sheet 1 to avoid the unintentional disconnection of one or more first brushes 2. In a preferred embodiment, the first brushes are V-shaped brushes. It is considered within the scope of the invention to vary the shape of the first brushes into other shapes, e.g., H-shaped, U-shaped or some other configuration having a converging pattern. Additionally, these brushes can be discontinuous, i.e., not one large brush, but formed of several smaller brushes. This configuration allows for replacement of the smaller brushes when necessary. Additionally, the flexible sheet may be provided with a number of affixing points allowing for re-configuration of the shape/orientation of the brushes along the plate. Moreover, while the all of brushes of the invention are typically fixedly installed at a right angle to the plate, other angles are also possible, e.g., 80, 75, 70 or any angle down to 45 degrees. The brushes can also be moveably joined to the plate with, e.g., a hinge, allowing the brushes themselves (in addition to the bristles) to change the angle along with the motion of the device along the surface of the water body.

The flexible sheet can also be provided with a plurality of middle brushes 3, installed in between the First brushes. The middle brushes are typically oblique or sideways, which have an angle to allow distributing the sediments as required. The middle brushes are designed to allow brushing and directing the sediments in the way to suction points 4 (FIG. 2). The middle brushes 3 are typically positioned to provide a brush section between the First brushes that would otherwise not be covered and therefore could not be cleaned. Such middle brushes allow redirecting the bottom water flow from such area into the First brushes in order to allow and efficient suction of the bottom water flow. The geometry and strategic placement of the First brushes allow directing the bottom water flow containing the settled impurities into apexes (17) (FIG. 7) of the First brushes.

The placement of the First brushes (2) and the middle brushes (3) allow for the suction device to be operated in both ways (12), i.e., forward and backward along a minor axis defined by the flexible sheet 1 (FIG. 3). As the device can be selectively operated in either direction, the time necessary to install and operate the device is reduced. Moreover, such a design allows for more even wearing of the brushes, by turning the suctioning device and changing its advance direction within predetermined periods of time. By turning the device according to predetermined periods of time, the brushes can be worn evenly, and therefore provide a more efficient action on the bottom of the large artificial water bodies.

The suction device can also include one or more of lateral brushes (5) positioned along one pair of extreme edges of the sheet, i.e., parallel to the direction of movement 12. The lateral brushes are configured and positioned to contain the suctioned water flow within the suction device to help to avoid re-suspension of a bottom water flow in the vicinity of the suction device. The position of the lateral brushes is selected to allow for an efficient flow there between, but to limit any exit of fluid from below the sheet along the sides.

Typically, the complete suctioning device is supported by the aforementioned brushes including the first brushes (2), the middle brushes (3), and the lateral brushes (5), which are strategically placed to provide an even support of the device's weight and allow a smooth operation and movement through the bottom of the water body. In other words, the sheet is spaced from the bottom surface of the water body primarily by the brushes, i.e., without any rollers, spacers or other friction causing device. Such even distribution of the weight of the suctioning device through the brushes also allows avoiding the suctioning device from lifting from the bottom when it is driven by the external propelling means.

As the device is completely supported by the different brushes, and the structural frame is a flexible sheet (1), the device allows an efficient cleaning of bottom surfaces that may have irregularities, bumps, holes, different slopes, and other imperfections that may prevent even cleaning of the bottom surface. The irregularities can be caused by the natural terrain below the liner, the installation of liners, geo-membranes, or coatings that present imperfections either due to the installation or the material itself. It must be noted that such imperfections may be accentuated over time, as terrain can settle or their properties can change. Such irregularities can be overcome by use of the brushes as the support of the device, allowing directing the water flow containing impurities into the apexes of the First brushes.

Therefore, the flexibility of the suctioning device is achieved by the combination of the use of a flexible sheet as the structural frame and the support by the brushes that allow a cleaning flexibility through the bottom of large artificial water bodies.

The bristles of the brushes described above can be made from commercially available materials, such as polypropylene, nylon, animal hair, vegetal fiber, carbon fiber, polyester, peek, polyethylene, polycarbonate, polystyrene, PTFE, PVC, acrylic fibers, rubbers, or metal wire bristles, among others. The brushes from the suctioning device can include a combination of different types of bristles to allow proper cleaning of the bottom of large artificial water bodies. It is also considered within the scope of the invention to use different materials for different brushes, depending upon the desired performance parameters. For example, in one embodiment, the bristles on the lateral brushes can be formed from PVC, while the bristles of the First brushes are formed from polyester fibers. Additionally, all the bristles of a single brush need not be formed from the same material.

The suctioning device also allows cleaning a combination of different sloped-bottoms from large artificial water bodies, which has not been possible to perform with the devices currently found in the market. Since the structural frame is a flexible sheet, the sheet can bend to provide cleaning of different sloped-bottoms.

The flexible sheet includes a plurality of suction points (4) configured to concentrate the suction capacity of an external pumping system and therefore provide a higher suction power in such suction points. The suction points can be located at the apexes (17) of the first brushes, such as V-Shaped brushes, in order to efficiently suction the bottom water flow that has been directed by the brushes into such suction points. The suction points additionally or alternatively may be located within the apexes of lateral brushes to provide even suctioning of the bottom water flow. The First brushes can direct the bottom sediments into a central suction point so that, for an equal external pumping power, the suction power is approximately 3 times higher than conventional cleaning devices.

As shown in FIG. 5, the flexible sheet can also be provided with a plurality of safety wheels (6). In some embodiments, the safety wheels are installed at a level that is higher than the brush level, i.e., where the distance from the sheet to the end of the brushes is greater than the distance from the sheet to the most distal point of the wheels. In some embodiments, the safety wheels are not necessary for permanent operation of the suctioning device. Such safety wheels can be used when the brushes are worn out and cannot provide the required support or suction height of the suctioning device. In such case, the wheels may serve as secondary support until the brushes are fixed or replaced. The safety wheels are typically positioned such that a lower surface thereof is higher than the brushes but lower than the suction points. As a result, during normal operation of the device, only the brushes contact the lower surface of the water body. When the brushes become worn or damaged and the device moves closer to the surface being cleaned, the safety wheels come in contact with the surface and prevent the suction points from pulling on the surface, getting stuck on the surface, or otherwise being damaged by the surface. Typically, the safety wheels are evenly disposed about the perimeter of the sheet, but it is considered within the scope of the invention to vary the position and spacing. Moreover, it is considered within the scope of the invention to utilize eccentric wheels, e.g., where the wheels are not circular (for example, oval or substantially rectangular with rounded edges) or are mounted on the plate through an off-center axis. This construction can allow for different suction results.

The flexible sheet may also comprise lateral wheels (21) disposed about the perimeter of the sheet, with their axles positioned parallel to the sheet (FIG. 5). The lateral wheels are designed to provide protection to prevent damage to the sheet and/or the walls of the water body.

The suction height may be determined specifically for each large water body to be cleaned, provided that it is designed to allow the suctioning device to contain the bottom water flow containing bottom impurities and settled solids, and not contain clean water. In other words, although the distance between the bottom of the brushes and the suction points, i.e., the suction height, can be generic, it is considered within the scope of the invention to modify the suction height, depending upon the particular characteristics of the water body to be cleaned. This can be accomplished by installing brushes with different lengths either all together, or to vary the lengths of the brushes on the same device.

The safety wheels are typically made from materials that will not cause major damage the bottom surface of the large artificial water bodies when they need to be used. Examples of the materials include polyethylene, polypropylene, polycarbonate, rubbers, plastics, polystyrene, PTFE, and PVC, among others.

As depicted, the suctioned water flow is sent into a plurality of collectors (7) through internal suction lines (9). The internal suction lines and the collectors are typically connected through different couplers (10) such as elbows, flanges, shafts, sleeve-style couplings, clamped couplings, and beam couplings, among other rigid or flexible coupling components. During typical operation of the suctioning device, a negative pressure is created by a pump (not shown) leading to the collectors, creating suction therein. Because the collectors are in fluid communication with the couplers, this suction is distributed to the suction points (4) via the internal suction lines and couplers. Depending upon the desired effect of the resulting suction, different reducers and/or expanders can be utilized to adjust the suction force applied at each suction point. The suction force at each suction point can be the same or different.

Figure 8:
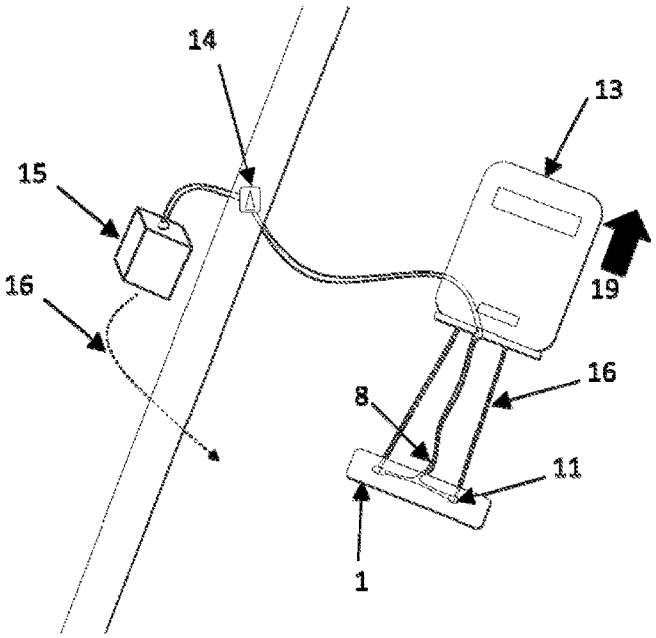
FIG. 8 shows that the suctioning device is attached to a propelling means, an external pumping system and a filtration system.

FIG. 8 shows that the suctioning device can be attached to a propelling device, an external pumping system and/or a filtration system. As depicted, the collector (7) is often configured to concentrate the suctioned water flow from a series of suction connection points (4) into one or more external suction lines (8) that is configured to send the suctioned water flow into an external pumping system. The number of external suction lines is commonly less than the number of internal suction lines to provide an efficient distribution of the suctioned water flow and reduce the need of external suction lines for connection with an external pumping system (14). The suctioned water flow is typically sent to the external pumping system through one or more external suction lines (8).

The collector (7) can include different concentration components, such as manifolds, multiple-inlet pipes, among others.

The connections between the different elements of the suctioning device and the flexible sheet can be accomplished by any method, including, but not limited to welding, brazing, soldering, adhesive bonding, and mechanical assembly such as screws, bolts and fasteners, among others.

The flexible sheet may include one or more arm connectors or joints (11) configured to attach an external propelling device (13) through one or more connection arms (16) to provide the required driving force and allow the suctioning device to move through the bottom of the large artificial water bodies.

Figure 9:
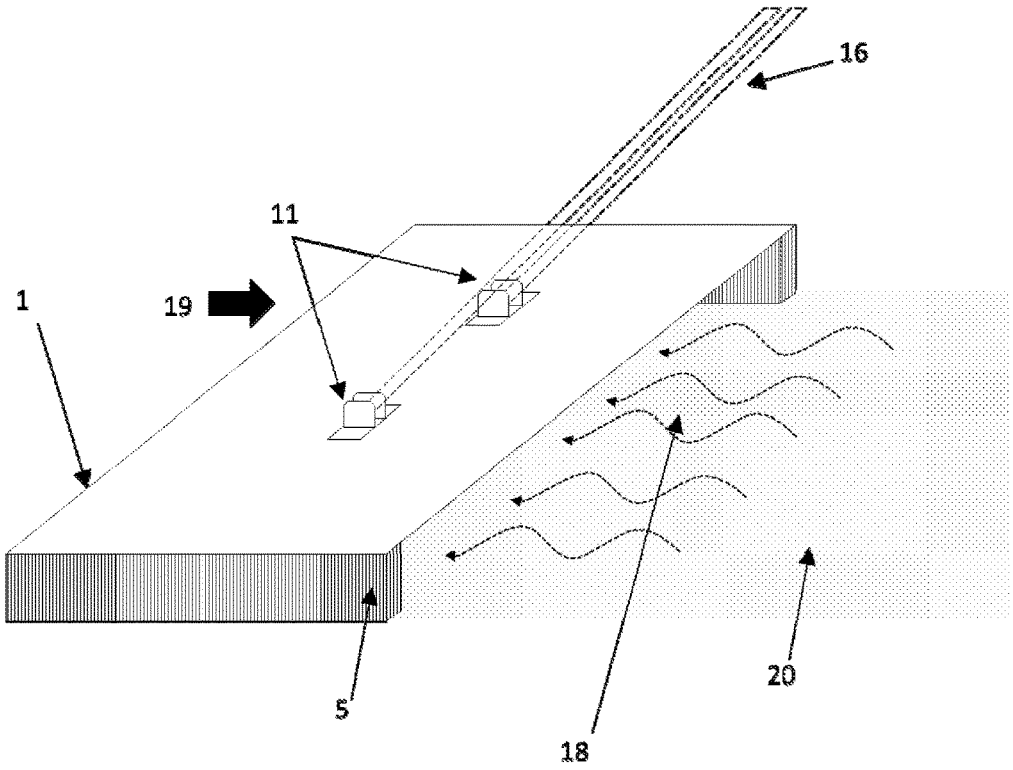
FIG. 9 shows an operation of the suctioning device, showing how an inlet water flow enters the device to be suctioned in an advancing direction.

FIG. 9 shows a typical operation of the suctioning device, showing how an inlet water flow (18) can enter the device to be suctioned in an advancing direction. The suctioning device may be propelled by a propelling device. As shown in FIG. 9, the device may be connected to the propelling device by one or more connector arms (16) attached to the arm connectors (11) attached to the flexible sheet. As the suction device is propelled, it moves in a certain advancing direction (19) along the bottom of the large artificial lagoon, letting an inlet water flow (18) into the suctioning device. The suctioning device allows suctioning of impurities and other settled material (20), thereby allowing thorough cleaning of the bottom surface.

The term "propelling device" is used generally to describe a propelling device that provides movement, either by pushing or pulling another device. In some embodiments, the propelling device can include a boat or structure floating or positioned atop the surface of the water body with an engine, underwater robotic systems, propellers, automatized means, or any system that allows providing the required driving force to the suctioning device. In some embodiments, the propelling device is included within the suctioning device, such as tracks. In some embodiments, the tracks can be caterpillar style tracks. In some embodiments, the propelling device is a catamaran type boat, with an engine, where the engine is located at the front of the boat in order to minimize mixing of the water below the boat and the re-suspension of settled impurities. In another embodiment, the propelling device is an underwater cart supported on a track system.

The suctioning device may include, either in addition or in an alternative, different systems and equipment to allow nocturnal operations and monitoring, such as underwater lights to illuminate the path of the suctioning device. The suctioning device may additionally have a camera for providing still images or videos of the suctioning operation of the device. The camera can be permanently fixed thereto or be removable therefrom.

Due to the configuration of the suctioning device, significantly greater velocities can be achieved when compared to conventional suctioning devices. The suctioning device of the present invention allows covering large irregular surfaces in short time without generating re-suspension or dispersion of the bottom impurities or flocs, as well as allowing cleaning the bottom and removing the bottom water flow at high speeds. The device of the invention allows covering large surface areas in short time, and is able to move at a speed of about 25 ft per minute, 30 ft per minute, 40 ft per minute, 50 ft per minute, or about 60 ft per minute, or about 70 ft per minute. As the device moves through the bottom, it will be able to cover a surface area equal to the advancing speed times the length of the device.

In some embodiments, the device may have a length of 9.85 ft and a speed of 28.5 ft per minute, and therefore the surface area cleaning rate will be 28.5 ft/min×9.85 ft=281 $ft^2$/min. Therefore, the total surface cleaning rate would equal to about 405,000 $ft^2$/24 hours (about 38,000 $m^2$/day). However, it is expected that approximately 20% of the time is required for cleaning or maintenance or speed reduction for turning or other reasons. Therefore, the suctioning device can be able to clean an area of about 325,000 $ft^2$ per 24 hours of operation (30,000 $m^2$ per 24 hours of operation) or more. The suctioning power of the suctioning device is typically greater than about 30 $m^3$/hr, greater than about 40 $m^3$/hr, greater than about 50 $m^3$/hr, greater than about 75 $m^3$/hr, and often on the order of about 90 $m^3$/hr.

It must be noted that conventional swimming pool cleaning devices that are designed and configured to be maneuvered by a person on the perimeter of the swimming pool cannot achieve the purpose of cleaning the large artificial water bodies as in the present invention. Also, the conventional swimming pool cleaning devices are designed to remove debris found on the bottom of concrete swimming pools that is flat, firm, and plain, which is completely different from the irregular bottoms of large artificial water bodies covered with different coatings, such as plastic geomembranes.

The suctioning device according to the present invention is configured to treat and maintain large artificial water bodies without a centralized filtration system, and is different than swimming pool technologies. The suctioning device is used when the sedimentation of suspended solids and organic matter, among others, is formed, and the suctioning device operates to remove the settled impurities from the bottom of the large artificial water bodies in order to avoid filtration of the complete water body. Therefore, the suctioning device includes suction points to remove the bottom settled impurities from the water body avoiding dispersing and re-suspending the flocs. The settled floccules are very fragile and can easily disperse, which is completely different from impurities removed from conventional swimming pools, which are generally composed of dirt, rust, calcium carbonate, or debris that has attached to the pool bottom and needs to be removed.

The suctioning device according to the present invention is able to achieve high speeds without causing re-suspension or dispersion of the fragile bottom impurities and settled solids in the vicinity of the suctioning device operation, and therefore does not affect the water quality or produce a sediment cloud that would otherwise be caused when conventional suctioning devices are operated at high speed. Moreover, the suctioning device is configured to allow advancing at a speed of around 66 ft per minute while moving though irregular bottoms, while at the same time avoiding the damage to the bottom materials. Using the device according to the present invention, the surface cleaning rate is more than 3 times higher than other available suctioning devices for large artificial water bodies without a centralized filtration system, and more than 4 times higher than conventional swimming pool cleaners.

For example, if suctioning devices have permanent fixed wheels to move across a lined bottom, irregularities on the bottom cannot be disregarded and the wheels may cause damage to the liner, causing it to tear apart, to fold, and to elongate, which affects its duration and will probably need to be replaced. Such damage to the bottom of large artificial water bodies may also cause considerably leaking, generating water losses and could cause environmental damage. Therefore, the suction device according to the present invention is typically evenly supported over the brushes in order to avoid causing tension or damage to bottom materials. Moreover, as the device according to the present invention is supported over the brushes, turning of the device is done more smoothly, thereby protecting the bottom material of the large artificial water bodies when turning is necessary. In contrast, where fixed wheels are used, turning of a device causes the fixed wheels to slide over the bottom material, as opposed to rolling, and therefore can cause the bottom to rip or break, which must certainly be avoided.

The suctioned water volume is dependent on the external pumping system and the load losses due to the piping distance and system configuration, among others. In some embodiments, the system is designed in order to allow that the effective volume introduced into the suctioning device is equal or higher than the amount of water suctioned by the external pumping system. The suctioning device according to the present invention is configured to have a certain advancing speed $\vec{V}_{SC}$, where the length $L_{SC}$ of the suctioning device is perpendicular to the moving direction, and the device has a suctioning height of $H_{SC}$.

Therefore, the total water volume, or inlet water volume (18) that will be fed into the suctioning device in a predetermined period of time can be calculated as:

$$\dot{Q}_{SC} = \vec{V}_{SC} \times L_{SC} \times H_{SC} \left[\frac{m^3}{s}\right]$$

The total suctioned water flow due to the suction power of the external pumping system is defined as $\dot{Q}_{PS}$. And therefore, the following equation can be defined:

$$\dot{Q}_{SC} \geq \dot{Q}_{PS}$$

Such relation can be explained as follows: To only suction and remove the water flow containing impurities and settled solids, the height of the suctioning device is defined to only suction such bottom water flow. As the suctioning devices advances, impurities will be captured within the brushes and suctioned through the suction points, as clean water passes through the device and is not suctioned. Therefore, the suctioned water flow from the external pumping system is configured to be lower than the water flow effectively entering the suctioning device, avoiding suctioning clean water that will be later purified and/or filtered. If the suction power from the external pumping system is higher than the water flow entering the suctioning device, the suction power could cause the device to stick to the bottom, not allowing its movement and potentially damaging the bottom material.

As shown in FIG. 8, in some embodiments, the suctioned water flow is sent to a purification and/or external filtration system (15), which allows filtering such suctioned water flow. The filtered water flow (16) can be later returned into the large water body. In some embodiments, the external filtration system is not part of the suctioning device, since given the large volumes of suctioned water due to the high advancing speed, a small filter attached to the suctioning device would not be sufficient to provide the required filtration of the suctioned water flow, or it would require a large filter that could not be attached to the suctioning device.

Example 1

The suctioning device according to the present invention was manufactured and installed in a large water body of 3.7 acres.

The water body included a LLDPE (linear low-density polyethylene) liner installed over a sandy soil, producing an irregular bottom that has to be cleaned thoroughly to maintain a proper water color and tonality within the large water body. Other technologies cannot clean such large water body, and therefore the suctioning device according to the present invention was developed and tested at such project.

The suctioning device included a flexible sheet built out of polycarbonate with a thickness of 10 mm to provide the required flexibility. The suctioning device had a surface area of about 3 $m^2$, and with approximate dimensions of 3 meters long and 1 meter wide. The height of the suctioning device was approximately 6 cm, which allowed only suctioning the bottom water flow that contains the impurities and debris, and not suctioning clean water that renders the process inefficient.

The brushes were made from polyethylene with polypropylene bristles, which do not damage the bottom material and have the capacity to support the suctioning device in the bottom and adapt to the irregular bottom surface to provide thorough cleaning.

The safety wheels were built out of UHMW PE (ultra high molecular weight polyethylene), using the same materials as for some parts of the suctioning device, which allows reducing manufacturing and material costs.

Six suction points were located at the apexes of the First brushes, and two additional suction points were located at the apexes of the lateral brushes, to provide an even suctioning of the bottom water flow. The total eight suction points were connected into two separate manifolds, where each manifold allowed connecting four suction points through internal suction lines. The suction connection lines were manufactured of PVC with 316 stainless steel elbows, to provide durability underwater.

The suctioning device was installed on the bottom of the lagoon, and two external suction pipes were connected to an external pumping system positioned on the perimeter of the large water body. The suctioning device was attached to a boat with an engine through two metal arms, which allowed driving the suctioning device along the bottom of the large water body.

The device was operated at a surface cleaning rate of 3.76 $ft^2$ per second (appx. 325,000 $ft^2$ per 24 hours considering the 20% time loss), allowing cleaning the complete bottom surface (3.7 acres) of the large water body in about 12 hours. The reduction of operation time allows reducing overall operation costs.

The total water flow that enters the suctioning device was lower than the suctioned water flow from the external pumping system, as some clean water passed through the device while impurities and settled solids found on the bottom were retained in the brushes and later eliminated through the suction points.

A comparison between the suctioning device of Example 1 of the present invention and another device for cleaning large artificial water bodies as shown in Table 2 can be made, where the first device had limitations associated with suctioning device speed, reversibility, turning capacity, suctioning efficiency, operation in irregular surfaces, support over wheels, and operation in sloped bottoms, among others.

TABLE 2

Comparison between a first suction device for Technology B and the device from the present invention used in Technology B

| Parameter | First Suction Device Developed for Technology B | Suction Device developed for Technology B according to the Present Invention |
|---|---|---|
| Dimensions (L × W × H) | 9.8 ft. × 3.3 ft. × 0.33 ft. | 9.8 ft. × 3.3 ft. × 0.16 ft. |
| Total Weight | 300 kg | 160 kg |
| Total Suction Power[1] | 32.4 $m^3$/h | 60 $m^3$/h |
| Total Manufacturing Cost | USD 22,000 | USD 10,000 |
| Reversibility | No | Yes |
| Production time | 1 month | 2 weeks |
| Turning Capacity | Limited | Very Good |
| Efficiency in suctioning bottom settled material | Regular, needs more than one pass to suction settled impurities | Very good, suctions more than 90% of settled impurities in one pass |
| Operation in irregular surfaces | Regular, may damage the bottom material | Very good, can adapt to irregular bottoms |
| Weight Support | Supported over wheels | Supported over brushes |
| Suction efficiency | Low due to continuous suction section at the bottom | High due to use of suction points that concentrate the suction power |
| Operation in sloped bottom | Regular | Very good |

[1]Both devices are compared by connecting to the same external pumping system

As it can be noted, the suctioning device according to the present invention is less expensive and can be easily installed in large artificial water bodies used either for recreational or industrial uses for cleaning the bottom of such large artificial water bodies using Technology B. By using the same external pumping system, the suction power of the suctioning device is increased due to the suction efficiency of the configuration used in the present device.

Example 2

The suctioning device according to the present invention was manufactured and installed at a large water body of 20 acres. The large water body had a bottom covered with a LLDPE liner installed over a sandy soil, producing an irregular bottom that has to be cleaned thoroughly to maintain a proper water color and tonality within the large water body. Due to the recreational nature of this project, the cleaning operations were performed during the night, and therefore the suctioning device and propelling device included special equipment, such as extra lights, and systems, such as GPS, to achieve such purpose.

The suction device had a flexible sheet built out of 316 steel with a thickness of 5 mm to provide the required flexibility and also the required weight to maintain the device underwater and avoid its lifting from the bottom while being driven by a propelling device. By providing a steel sheet, the weight was distributed along the complete device, improving its stability. The suctioning device had a surface of about 3 $m^2$, and with approximate dimensions of 3 meters long and 1 meter wide. The height of the suctioning device was approximately 4 cm, which allowed only suctioning the bottom water flow that contained the impurities, and not the suctioning clean water which would render the process inefficient.

The brushes were made from polyethylene with polypropylene bristles, which do not damage the bottom material and have the capacity to support the suctioning device in the bottom and adapt to the irregular bottom surface to provide thorough cleaning.

The safety wheels were built out of UHMW PE, using the same materials as for some parts of the suctioning device, which allows reducing manufacturing and material costs.

Six suction points were located at the apexes of the first brushes, where the first brushes were V-shaped brushes, and two additional suction points were located at the apexes of the lateral brushes, to provide an even suctioning of the bottom water flow. Eight total suction points were connected into two separate manifolds, where each manifold allowed connecting four suction points through internal suction lines. The suction connection lines were manufactured of PVC with 316 stainless steel elbows, to provide durability underwater, and were welded to the steel base plate. The suctioning device was installed in the bottom of the lagoon, and two external suction pipes were connected to the external pumping system located on the perimeter of the large water body. The suctioning device was attached to a boat with an engine through two metal arms, which allowed driving the suctioning device through the bottom of the large water body, and where an operator was in charge of driving the boat with an engine.

Two underwater lights were installed into the suctioning device, in order to allow its night-time operation. An underwater camera was installed which permitted monitoring of the cleaning operation live from a remote location outside the water body and also for the operation driving the boat.

The device was operated at an average surface cleaning rate of 500 $ft^2$ per minute, allowing cleaning about half of the bottom in about 12 hours, which operated within a period from 21:00 hrs to 09:00 hrs of the next day. In order to be able to complete the cleaning of the entire lagoon in a single night, a second suctioning device was utilized.

As it can be noted, the suctioning device according to the present invention is less expensive and can be easily installed in large artificial water bodies used either for recreational or industrial uses for cleaning the bottom of such large artificial water bodies. Further, the suctioning device can also be operated during the night to avoid disturbing the recreational activities during the day.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

The invention claimed is:

1. A suctioning device for suctioning a water volume from a bottom of large artificial water bodies, with surfaces larger than 10,000 $m^2$, without centralized filtration systems, where the suctioning device is capable of cleaning at a surface rate of 325,000 $ft^2$ per 24 hours (30,000 $m^2$ per 24 hours) or more, the device comprising:

a flexible sheet configured to provide a structural frame;

a plurality of first brushes depending from the sheet;

a plurality of middle brushes configured to redirect a bottom water flow into the first brushes;

a plurality of lateral brushes configured to contain the bottom water flow within the suctioning device and avoid a re-suspension of the bottom water flow in the vicinity of the suctioning device;

a plurality of suction points through which the bottom water flow is suctioned;

a plurality of safety wheels configured to provide secondary support and avoid damage to the suctioning device when the first brushes, the middle brushes, and/or the lateral brushes are worn out and cannot provide a proper support or suction height of the suctioning device;

a plurality of collectors configured to gather the suctioned bottom water flow and concentrate the suctioned bottom water flow into one or more external suction lines;

a plurality of internal suction lines configured to conduit the suctioned bottom water flow from the plurality of suction points to the plurality of collecting means; and a coupling device connecting the internal suction lines and the collectors.

2. The suctioning device according to claim 1, wherein the first brushes are shaped to have an apex.

3. The suctioning device according to claim 2, wherein the suction points are located at the apexes of the first brushes and at apexes of the lateral brushes.

4. The suctioning device according to claim 1, wherein the first brushes are V-shaped brushes.

5. The suctioning device according to claim 1, wherein the bottom water flow entering the suction device comprises flocs produced by flocculants or coagulants.

6. The suctioning device according to claim 1, wherein the rate ($\dot{Q}_{SC}$) of the bottom water flow entering the suctioning device is the same or higher than the rate ($\dot{Q}_{PS}$) of the water flow suctioned by the external pumping system according to the following equation:

$$\dot{Q}_{SC} = \left[\frac{m^3}{s}\right] \geq \dot{Q}_{PS}\left[\frac{m^3}{s}\right].$$

7. The suctioning device according to claim 6, wherein the rate ($\dot{Q}_{SC}$) of the bottom water flow entering the suctioning device is defined as:

$$\dot{Q}_{SC} = \vec{V}_{SC} \times L_{SC} \times H_{SC}\left[\frac{m^3}{s}\right],$$

wherein $\vec{V}_{SC}$ is an advancing speed of the suctioning device, $L_{SC}$ is a length of the suctioning device that faces in a moving direction, and $H_{SC}$ is a height of the suctioning device that faces in the moving direction.

8. The suctioning device according to claim 1, wherein the first brushes, the middle brushes, and the lateral brushes are configured and placed in the flexible sheet to allow the suctioning device to operate both in a first direction and in a second direction substantially opposite to the first direction.

9. The suctioning device according to claim 1, wherein the suctioning device is evenly supported by the first brushes, the middle brushes, and the lateral brushes in order to move through a water body and avoid the suctioning device to lift from a bottom surface of the water body.

10. The suctioning device according to claim 1, wherein the flexible sheet is made from a material selected from polycarbonate, polypropylene, carbon fiber, polyethylene, polystyrene, PTFE, PVC, acrylic, and metallic materials.

11. The suctioning device according to claim 1, wherein bristles of the first brushes, the middle brushes, and the lateral brushes are made from a material selected from polypropylene, nylon, animal hair, vegetal fiber, carbon fiber, polyester, peek, polyethylene, polycarbonate, polystyrene, PTFE, PVC, rubbers, acrylic fibers, and metal wire bristles.

12. The suctioning device according to claim 1, wherein the safety wheels are built out of a material selected from polyethylene, polypropylene, polycarbonate, rubbers, plastics, polystyrene, PTFE, and PVC.

13. The suctioning device according to claim 1, wherein the safety wheels provide secondary support to the device.

14. The suctioning device according to claim 1, further comprising lateral wheels for providing a bumper to avoid damage to lateral walls.

15. The suctioning device according to claim 1, wherein the suctioning device is able to clean a combination of different sloped bottoms from large artificial water bodies.

16. The suctioning device according to claim 1, wherein the device is designed to clean irregular bottoms of sand or soil covered with plastic liners.

17. The suctioning device according to claim 1, wherein the coupling means comprise rigid or flexible coupling components selected from elbows, flanges, shafts, sleeve-style couplings, clamped couplings, and beam couplings.

18. The suctioning device according to claim 1, wherein the collecting means comprise different concentration components, such as manifolds, and multiple-inlet pipes.

19. The suctioning device according to claim 1, wherein elements of the suctioning device are connected to the flexible sheet by means of welding, brazing, soldering, adhesive bonding, and/or mechanical assembly such as screws, bolts and fasteners.

20. The suctioning device according to claim 1, wherein the flexible sheet comprises one or more arm connectors configured to attach one or more connection arms.

21. The suctioning device according to claim 20, wherein the one or more connection arms are connected to propelling device to provide a required driving force and allow the suctioning device to move through the bottom of the large artificial water bodies.

22. The suctioning device according to claim 1, wherein the flexible sheet comprises one or more connections for connecting a propelling device.

23. The suctioning device according to claim 22, wherein the propelling device comprises a boat with an engine.

24. The suctioning device according to claim 22, wherein the propelling device comprises a track system.

25. The suctioning device according to claim 22, wherein the propelling device comprises an automated system located within the suctioning device.

26. The suctioning device according to claim 25, wherein the automated system comprises a caterpillar system.

27. The suctioning device according to claim 1, wherein the bottom water flow entering the suctioning device is dependent on an advancing speed, an advancing length and the suction height of the suctioning device.

28. The suctioning device according to claim 1, wherein the water flow suctioned by the external pumping system is sent to a filtration system and a purified water flow is returned into a large water body.

29. The suctioning device according to claim 28, wherein the filtration system is not attached to the suctioning device.

30. The suctioning device according to claim 1, further comprising a plurality of underwater lights in order to illuminate a path of the suctioning device.

31. The suctioning device according to claim 1, further comprising a plurality of cameras in order to provide images and/or video for monitoring an operation of the suctioning device.

* * * * *